US007344043B2

(12) United States Patent
Nyeboer

(10) Patent No.: US 7,344,043 B2
(45) Date of Patent: Mar. 18, 2008

(54) PARTITION ASSEMBLY MADE WITH MULTIPLE PLY PARTITIONS

(75) Inventor: Calvin D. Nyeboer, Holland, MI (US)

(73) Assignee: Bradford Company, Holland, MI (US)

( * ) Notice: Subject to any disclaimer, the term of this patent is extended or adjusted under 35 U.S.C. 154(b) by 359 days.

(21) Appl. No.: 11/036,809

(22) Filed: Jan. 14, 2005

(65) Prior Publication Data

US 2006/0157488 A1 Jul. 20, 2006

(51) Int. Cl.
*B65D 1/24* (2006.01)
*B65D 1/36* (2006.01)
*F25D 23/00* (2006.01)

(52) U.S. Cl. ..... 220/552; 220/592.2; 220/507

(58) Field of Classification Search ..... 220/552, 220/592.26, 510, 507, 553; 229/120.06–120.07, 229/120.13, 120.25
See application file for complete search history.

(56) References Cited

U.S. PATENT DOCUMENTS

| | | | | |
|---|---|---|---|---|
| 2,647,679 | A * | 8/1953 | Schilling et al. | 229/120.36 |
| 3,399,098 | A | 8/1968 | Omoto et al. | 156/200 |
| 3,487,479 | A * | 1/1970 | Grooms | 5/93.1 |
| 3,647,607 | A * | 3/1972 | Hillers | 428/139 |
| 3,859,161 | A | 1/1975 | McLeod | 161/44 |
| 3,873,407 | A * | 3/1975 | Kumata et al. | 428/215 |
| 3,921,891 | A | 11/1975 | Gorham | 229/15 |
| 4,127,304 | A | 11/1978 | Gardner | 229/15 |
| 4,224,376 | A | 9/1980 | Ishige et al. | 428/315 |
| 4,375,263 | A | 3/1983 | Dworkin | 206/425 |
| 4,898,640 | A | 2/1990 | O'Connor | 156/204 |
| 5,732,876 | A | 3/1998 | Bradford | 229/120.07 |
| 5,788,146 | A | 8/1998 | Bradford et al. | 229/120.07 |
| 5,876,813 | A | 3/1999 | Bambara et al. | 428/36.5 |
| 5,882,776 | A | 3/1999 | Bambara et al. | 428/215 |
| 5,938,878 | A | 8/1999 | Hurley et al. | 156/219 |
| 6,054,005 | A * | 4/2000 | Hurley et al. | 156/219 |
| 6,167,790 | B1 | 1/2001 | Bambara et al. | 83/13 |
| 6,375,779 | B1 * | 4/2002 | Melquist et al. | 156/212 |
| 6,416,854 | B2 * | 7/2002 | Hunter, Jr. | 428/319.1 |
| RE38,707 | E | 3/2005 | Merkel | |
| 2004/0118854 | A1 * | 6/2004 | Kutun | 220/507 |

FOREIGN PATENT DOCUMENTS

| | | | |
|---|---|---|---|
| JP | 404065235 A | 3/1992 | 156/242 |

* cited by examiner

*Primary Examiner*—Anthony D. Stashick
*Assistant Examiner*—Shawn M. Braden
(74) *Attorney, Agent, or Firm*—Wood, Herron & Evans, LLP

(57) ABSTRACT

A partition assembly comprising a partition matrix made up of intersecting first and second slotted partitions, each of the partitions having at least one slot. The slots of the partitions are engaged with each other at a plurality of intersections. The partitions are made by folding over a partition blank and securing a foam portion of the folded partition blank to itself. The foam may be heated with hot air before being cooled under pressure to secure opposed plies of the partition together.

19 Claims, 6 Drawing Sheets

FIG. 5C1

PARTITION ASSEMBLY MADE WITH MULTIPLE PLY PARTITIONS

FIELD OF THE INVENTION

The present invention relates to a partition assembly for dividing the space inside a container or box; more particularly to a partition assembly made of slotted, multiple ply partitions.

DESCRIPTION OF THE PRIOR ART

In the storage, shipment or display of parts or merchandise, it is a common practice to divide the interior of a box or container into a plurality of individual cells. The interior of a box or container is typically separated by a series of dividers, one set of parallel dividers being orthogonal to a second set of dividers. The dividers separate the interior of the container into a plurality of individual holding cells each of which is intended to hold a separate item for display and/or shipment. The division of the interior of the box or container helps prevent the items therein from contacting one another and breaking during shipping. The division or partitioning of the container also aids in the loading and unloading of the items therein, as well as inventorying the contents of each box or container.

The dividers typically are slotted and arranged in an orthogonal relationship to divide the interior of the box or container into a desired number of holding cells. The dividers are slotted in a manner that enables the dividers to engage with one another at the location of the slots so that the dividers form an orthogonal grid or matrix. Typically the dividers are made of the same material as the material of the box or container, plastic or paperboard. However, the dividers may be constructed of any suitable material with sufficient rigidity to prevent the contents of the container from contacting one another and being damaged.

One disadvantage with known partition assemblies is that the upper edges of the partitions may have exposed sharp edges. For example, corrugated plastic partitions may have sharp upper edges created by cutting a sheet of corrrugated plastic to the desired partition size. Such an exposed upper edge of the partition may damage products or parts being loaded into or unloaded from the cells of the container in which is located the partition matrix or assembly. Partition assemblies incorporating partitions having exposed sharp upper edges may require additional clearance between the parts being either loaded or unloaded and the upper edges of the partitions.

Another disadvantage of such partition assemblies is that the person loading or unloading parts or products into or from the cells of the container may cut or scrape their knuckles or hands on the exposed upper edges of the partitions when loading or unloading parts or products.

Additionally, the stiffness of the partitions of the assembly is dictated by the material from which the partitions are made. The stiffness of the partitions may not be altered without changing the material from which the partition is made.

U.S. Pat. No. 2,647,679 discloses a partition assembly which separates the interior of a box or container into a plurality of cells. The partitions of the assembly disclosed in this patent are formed by folding a blank of material along a fold line so as to create a rounded smooth upper edge. The material is disclosed as being paper board or similar material.

Another partition assembly for dividing the interior of a container is disclosed in U.S. Pat. No. 4,375,263. The partitions of this assembly are similarly rounded along their upper edges and are made of transparent vinyl sheets.

In each of these prior art partition assemblies, the opposed plies of the dividers or partitions formed by folding a blank of material are not secured to each other. Consequently, the opposed sides or plies of the partitions are not secured to each other and may be easily separate, thereby expanding into the cells of the container defined by the partition assembly. Consequently, the partitions may contact the products or parts stored in the cells and damage them. Additionally, the partition plies may easily tear or otherwise be damaged. Upon assembly or disassembly of the partition matrix, one or more portions of the partitions may tear and hence cause disassembly of at least a portion of the partition matrix.

It therefore has been one objective of the present invention to provide a double-ply partition for use in a partition assembly in which the plies are secured together.

It has been a further objective of the invention to provide a method of manufacturing a double-ply partition for use in a partition assembly which is secure and may not be easily disassembled.

It has been another objective of the present invention to provide a double-ply partition for use in a partition assembly in which the partition has the desired degree of stiffness.

SUMMARY OF THE INVENTION

The partition assembly of the present invention which accomplishes these objectives comprises at least one first slotted partition intersecting with at least one second slotted partition at an intersection. The intersecting first and second slotted partitions form a plurality of holding cells into which different parts are stored for shipment or display.

Each first slotted partition has at least one slot extending inwardly from an edge of the first slotted partition. Likewise each second slotted partition has at least one slot extending inwardly from an edge of the second slotted partition. Preferably the slots are evenly spaced in order to make the holding cells which are defined by the intersecting partitions of identical dimensions. However, the slots may be located at any desired locations. In one embodiment, each of the slots of a first slotted partition extends inwardly from an edge of the first slotted partition to approximately the midpoint of the first slotted partition. Each of the slots of a second slotted partition extends inwardly from an edge of the second slotted partition to approximately the midpoint of the second slotted partition.

In one embodiment of the present invention, the partition is formed of a multilayered material folded in half and secured to itself. The fold creates a rounded upper edge at the fold line which is smooth and has a continuous surface with the outer side walls or skins of the partition. The partition blank comprises an inner layer of foam, preferably polyolefin foam, and an outer layer, skin or facegood. In one embodiment, the inner foam layer is bonded directly or laminated to the outer layer. The outer layer may be made of woven polyester, non-woven polypropylene, foamed or solid polyolefin or other material such as latex or non-polyolefin plastic. The outer layer may be selected as appropriate to protect or prevent surface damage to the products being stored and/or shipped in the cells of the container.

In an alternative embodiment, a desired stiffness or rigidity may be created in the partition by inserting into the partition blank from which the partition is made a thin plastic skin or middle layer between the inner foam layer and the outer layer or facegood. By altering the thickness and/or mechanical properties of this middle layer, or by omitting it altogether, the desired level or degree of stiffness of the partition may be achieved during the manufacturing process.

In an alternative embodiment, the partition blank may be made solely of one foam layer without any outer layer or facegood.

The method of manufacturing the multiple ply partition comprises multiple steps. Although the method is described with respect to one preferred embodiment, the method may be used with any of the embodiments contemplated by this invention.

In one instance, a multiple layered partition strip or blank having an outer skin secured to a foam interior is first provided. This partition blank may be made using any desired known method such as co-extrusion, lamination, etc.

The partition blank is folded so as to create two opposed plies and a smooth edge connecting the plies. The foam interior layer of at least one of the plies is heated with a heat source. The heat source is placed in such proximity to the contacting portions of the partition plies so that heat from the heat source causes the foam portion of at least one of the partition plies to become at least partially molten. The heat source is then distanced from the partition plies and the foam portions of the partition plies allowed to cool under pressure, thereby creating a securement of the foam layers or portions of the partition plies to create a unitary partition having a foam interior portion surrounded by an outer skin. The heat source may be hot air or any other suitable heat source.

In this manner, the plies of the partition are parent welded or fused together along their interior or inner surfaces. For purposes of this document, the term "parent weld" or "parent weldment" refers to a weldment of two contacting partition plies welded, fused or secured together without the use of any additional material other than the material of the partition plies themselves. The present invention is not intended to be limited strictly to foam, partition plies made of corrugated plastic may be parent welded together in accordance with the present invention in a manner disclosed and taught in assignee's U.S. Pat. No. 5,788,146, which is fully incorporated herein.

One advantage of using a partition blank having a foam interior made of a polyolefin foam is that the two plies of the partition blank may be secured or fused together using only heat, thereby eliminating the need for additional material such as adhesive, staples or other fasteners. The omission of the additional material may reduce the labor and material cost of making the slotted partition. The securement of the two plies together using only heat may not be possible or economically desirable with other materials such as paperboard, commonly used to make partitions.

Such a process of welding opposed plies of a partition together without the use of any additional material other than the material of the partition plies to form a multiple ply partition having the desired stiffness is quick, economical and allows many multiple ply partitions to be mass produced with low material and labor costs. Once the portion of at least one ply is separated from the heat source and allowed to cool, the plies are parent welded together in a permanent relationship.

An alternative method of joining the foam interior layers of the plies of the partition is to adhesively secure them together. Other means of securing the foam interior layers of the folded partition plies may used if desired.

This method of making a two ply partition by securing opposed plies of the partition together is quick, easy and inexpensive. The opposed plies of the partition are permanently secured to each other, making the partition nondisassembling and enhanced by being double layered or double ply without using any additional material or tools.

BRIEF DESCRIPTION OF THE DRAWING

FIG. 5C1 is a perspective view illustrating the interior foam layers of opposed plies of the partition blank of FIG. 5A being joined without heat;

DETAILED DESCRIPTION OF THE PREFERRED EMBODIMENT

Figure 1:
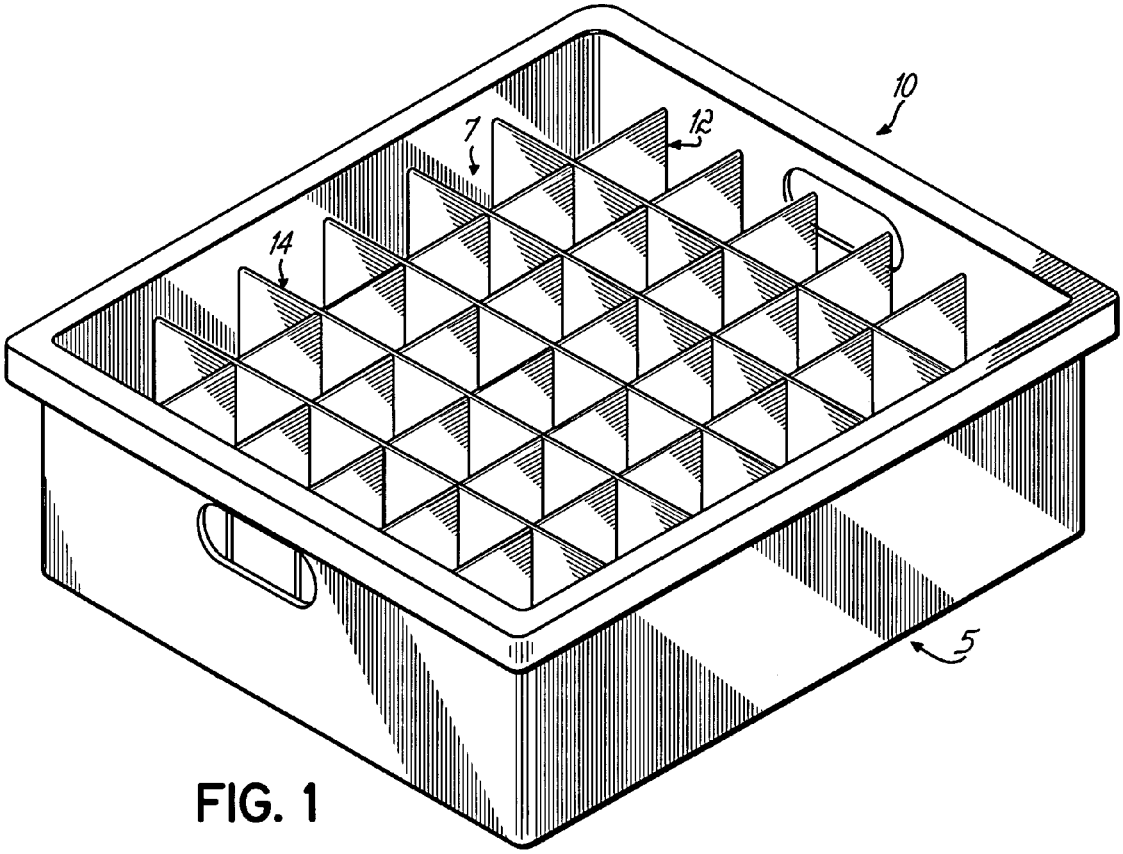
FIG. 1 is a perspective view of the partition assembly of the present invention located inside a container.
Figure 2:
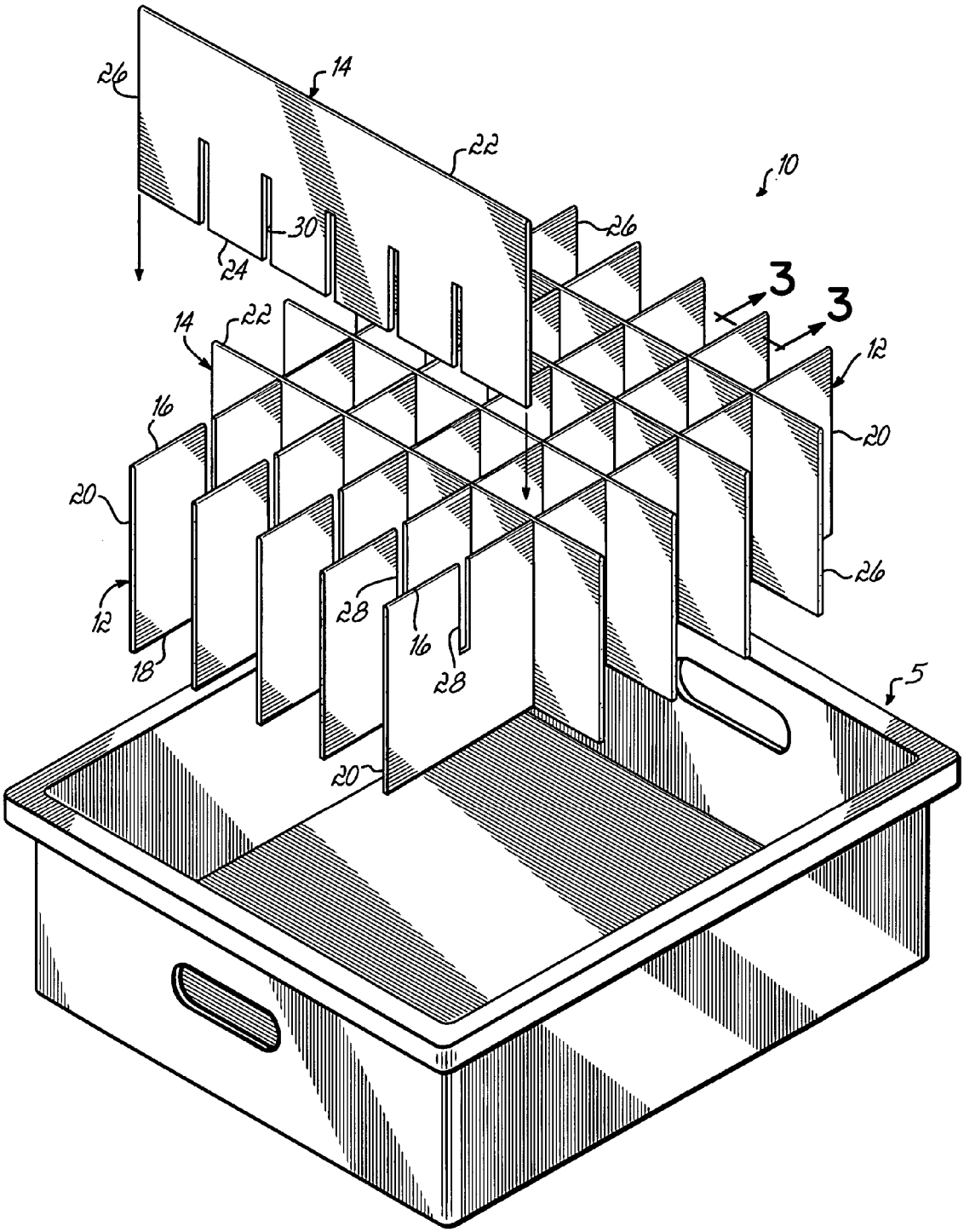
FIG. 2 is a perspective view of the construction of the partition assembly of FIG. 1 illustrating a plurality of first slotted partitions and a plurality of second slotted partitions.

Referring to the drawings and particularly to FIG. 1, there is illustrated a partition assembly 10 for dividing the space inside a container 5. Although one type or configuration of container 5 is illustrated in FIG. 1, the partition assembly 10 of the present invention may be used in any type of container or box. As illustrated in FIG. 2, the partition assembly 10 comprises a plurality of parallel first slotted partitions 12 intersecting with a plurality of parallel second slotted partitions 14.

As shown in FIG. 2, each first slotted partition 12 has a rounded upper or top edge 16, a planar bottom edge 18 and two opposed side edges 20. Likewise each second slotted partition 14 has a rounded upper or top edge 22, a planar bottom edge 24 and two opposed side edges 26.

Each first slotted partition 12 has at least one slot 28 which extends downwardly from the top edge 16 of the first slotted partition 12 to approximately the midpoint of the first slotted partition 12. The slots 28 may be evenly spaced apart in order that the individual holding cells 7 of the partition assembly may be evenly sized. See FIG. 1. Alternatively, the slots 28 of the first slotted partitions 12 may be unevenly spaced in order to form holding cells of the partition assembly of differing sizes to accept different sized parts. The slots 28 are shown as being vertical but may be horizontal if the partition assembly 10 is placed on edge.

As shown in FIG. 2, each second slotted partition 14 has at least one slot 30 extending upwardly from the bottom edge 24 of the second slotted partition 14 to approximately the midpoint of the second slotted partition 14. The slots 30 of the second slotted partitions 14 may also be evenly spaced in order so that the holding cells 7 of the partition assembly 10 may be evenly sized. Again see FIG. 1. Alternatively, the slots 30 may be unevenly spaced in order to form holding cells of the partition assembly of differing sizes adapted to accept different sized parts. The slots 30 are shown as being vertical but may be horizontal if the partition assembly 10 is placed on edge.

Figure 3:
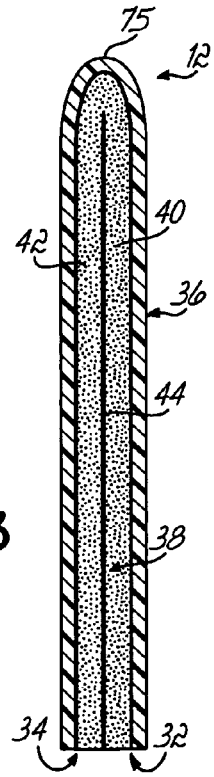
FIG. 3 is a cross-sectional view taken along the line 3-3 of FIG. 2.

In one embodiment of the present invention each of the first and second slotted partitions 12, 14 is made of a multilayered material. Each of the partitions 12, 14 is a two-ply partition formed by the method shown in FIGS. 5A-5F and described below. FIG. 3 illustrates one of the partitions 12 in detail according to one embodiment of the present invention. As best illustrated in FIG. 3, slotted partition 12 has two opposed plies 32 and 34 which are parallel to one another and joined together. The partition 12 has an outer layer or skin 36 assuming a generally inverted U-shaped configuration when the partition 12 is folded and the opposed plies 32 and 34 secured together. A wide variety of materials may be used for the outer layer or skin 36 including, but not limited to, woven polyesters, non-woven polypropylenes, foamed and solid polyolefins, latex, non-polyolefin plastics.

In the embodiment shown in FIG. 3, inside the outer layer or skin 36 is a foam interior 38 comprising two layers 40, 42 joined together along an interior surface 44. A wide variety of materials may be used for the foam interior 38 of the partition 12. In one preferred embodiment, the foam interior 38 is a polyolefin foam. However, other materials other than foam which may be welded or joined together may be used in accordance with the present invention. If desired, the outer skin 36 may be omitted, in which case, the entire partition 12 would be made of foam.

Figure 3A:
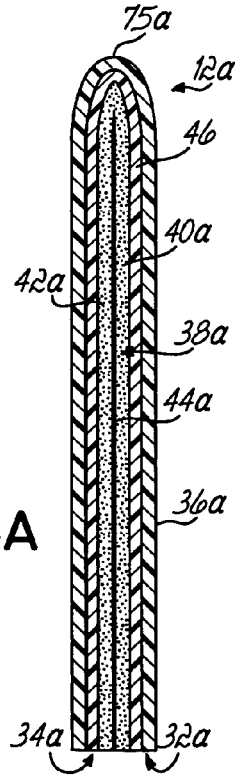
FIG. 3A is a cross-sectional view of an alternative embodiment of a partition used in accordance with the present invention having a middle layer.

FIG. 3A illustrates an alternative embodiment of the present invention. In this embodiment, partition 12*a* has an additional layer incorporated therein when compared to the partition 12 shown in FIG. 3. In this alternative embodiment, the partition 12*a* has an outer layer or skin 36*a*, a foam interior 38*a* comprising two layers 40*a*, 42*a* joined together along surface 44*a*. In addition, a middle stiffening layer 46 is secured between the outer layer or skin 36*a* and the foam interior 38*a*. Like the outer layer 36*a* of the partition 12*a*, the middle stiffening layer 46 assumes a generally inverted U-shaped configuration when the partition 12*a* is folded and the opposed plies 32*a* and 34*a* secured together as shown in FIG. 3A. A wide variety of materials may be used for the middle stiffening layer or skin 46 including, but not limited to, various plastics. If desired, additional middle stiffening layers of any suitable material (not shown) may be added to the partition blank. The partition 12*a* has a smooth upper edge 75*a* like the partition 12 shown in FIG. 3 created by the folding of a partition blank and securing the opposed plies 32*a*, 34*a* together in the manner described below.

Figure 4A:
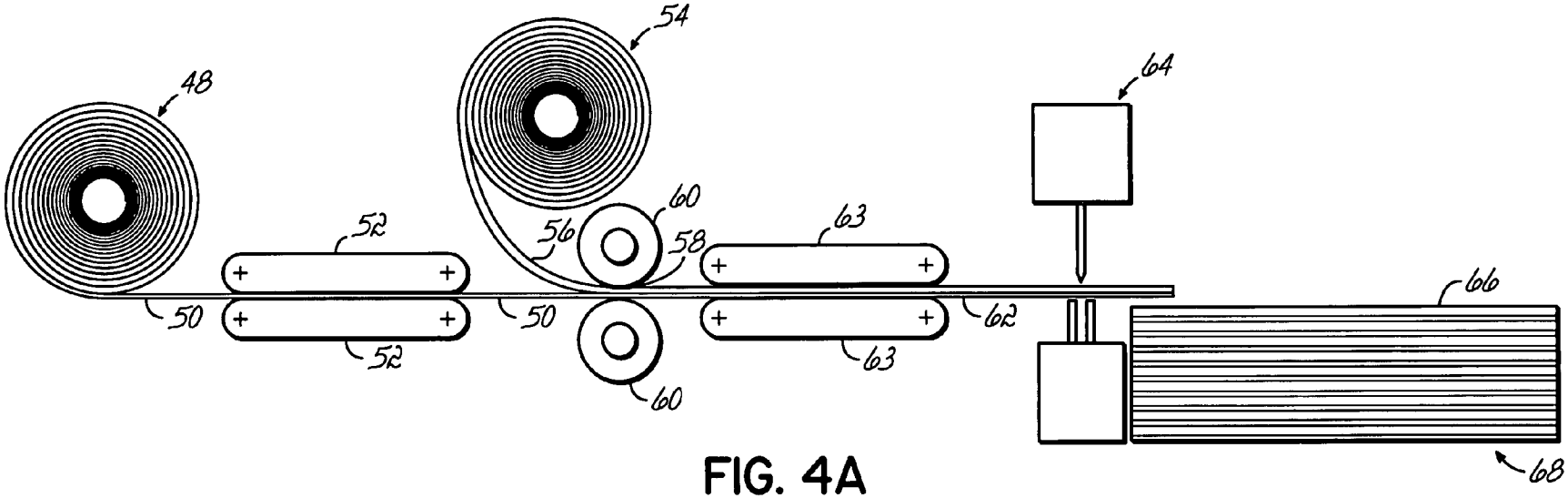
FIG. 4A is a diagrammatic side elevational view illustrating a method of manufacturing partition blanks according to one embodiment of the present invention.

Referring to FIG. 4A, to practice the method of this invention and form a multilayered partition blank 66 for subsequent use in forming a slotted two ply partition like partition 12 shown in FIG. 3 for use in a partition assembly, a roll 48 of outer skin material is provided. As illustrated in FIG. 4A, a web of outer skin material 50 is unwound from the roll 48 and passed between two heated conveyors 52. Other heat sources may used if desired. Another roll 54, this one containing a web 56 of foam material is provided. The continuous web 56 of foam is unrolled from the roll 54 and passed into a nip 58 between rollers 60. The webs 50, 56 are joined together to create a multilayered web 62. As shown in FIG. 4A, the multilayered web 62 is passed between cooling conveyors 63 and then cut with cutting device 64 to create a partition blank 66. Any suitable means for cooling the multilayered web 62 other than conveyors may be used if desired. The cut multilayered partition blanks 66 are then stacked on top of one another to create a stack 68.

Figure 4B:
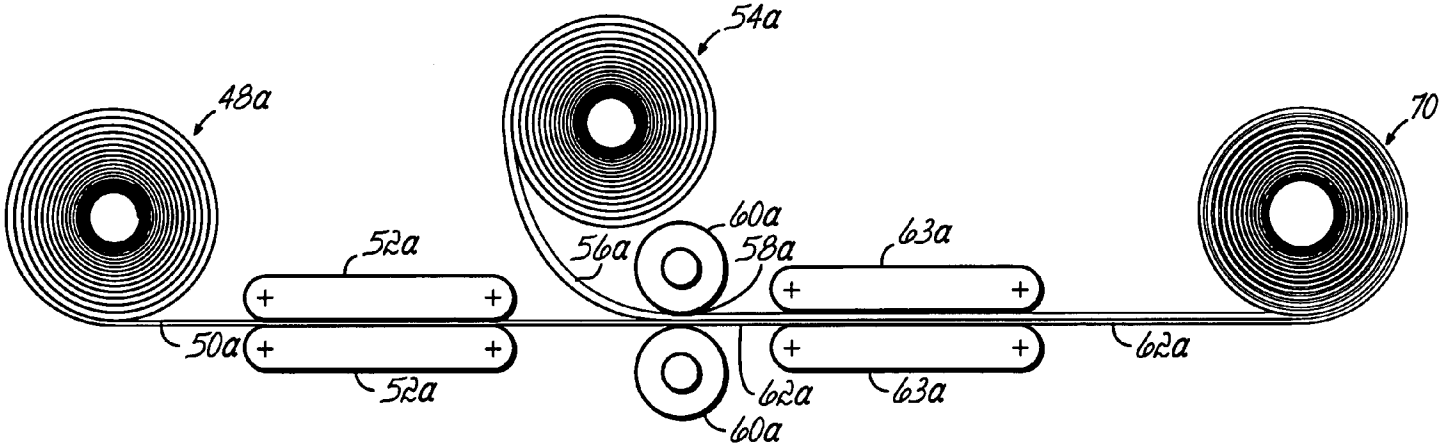
FIG. 4B is a diagrammatic side elevational view illustrating a method of manufacturing a roll of material used to make partition blanks according to another embodiment of the present invention.
Figure 4C:
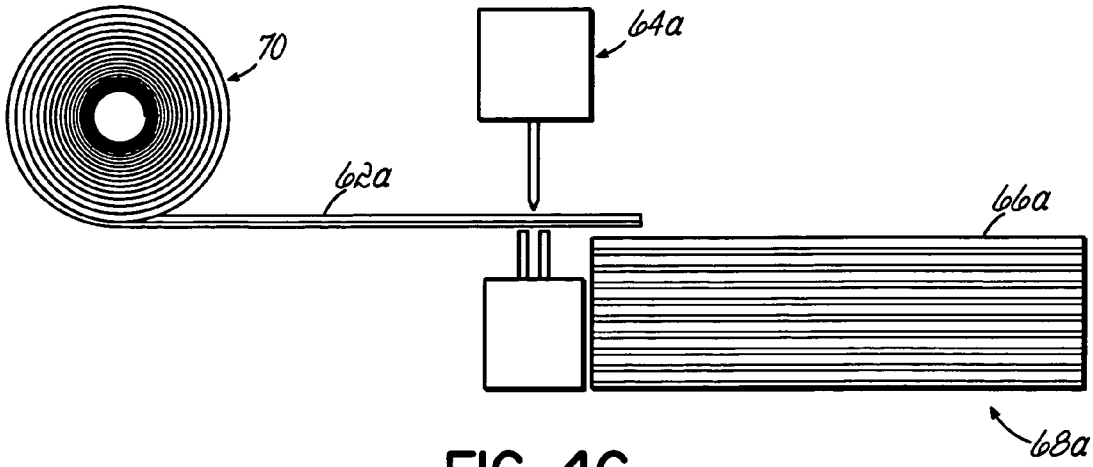
FIG. 4C is a diagrammatic side elevational view further illustrating the method of manufacturing partition blanks according to the method of FIG. 4B.

FIGS. 4B and 4C illustrate another method of forming a cut multilayered partition blank 66*a*. In this method, a roll 48*a* of outer skin material is provided. As illustrated in FIG. 4B, a web of outer skin material 50*a* is unwound from the roll 48*a* and passed between two heated conveyors 52*a*. Again, other heat sources other than conveyors may used if desired. Another roll 54*a*, this one containing a web 56*a* of foam material is provided. The continuous web 56*a* of foam is unrolled from the roll 54*a* and passed into a nip 58*a* between rollers 60*a*. The webs 50*a*, 56*a* are joined together to create a multilayered web 62*a*. As shown in FIG. 4B, the multilayered web 62*a* is then passed between cooling conveyors 63*a* before being rolled up into a roll 70. As illustrated in FIG. 4C, the multilayered web 62*a* is unrolled from roll 70 and cut with cutting device 64*a* at one or more desired locations to create a partition blank 66*a*. The partition blanks 66*a* are then stacked to create a stack 68*a*.

Although FIGS. 4A-4C illustrate several method of manufacturing a multilayered partition blank, any other suitable known method of making a multilayered partition blank may be used such as co-extrusion, heat bonding or laminating several layers together.

Figure 5A:
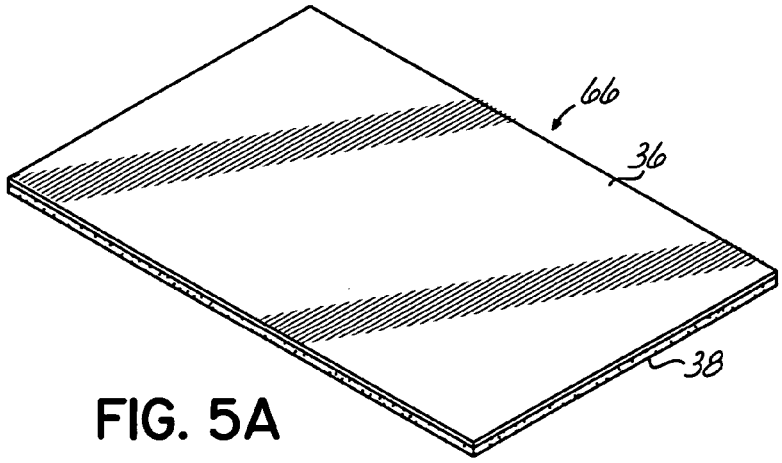
FIG. 5A is a perspective view of a partition blank.
Figure 5B:
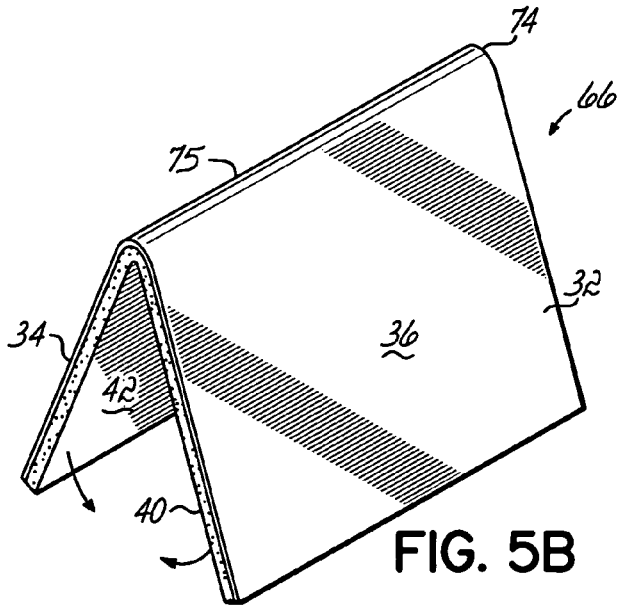
FIG. 5B is a perspective view illustrating the partition blank of FIG. 5A being folded.

Once a multilayered partition blank 66, 66*a* has been created, the multilayered partition blank is then formed into a two-ply slotted partition 12 using the method illustrated in FIGS. 5A-5F. For purposes of simplicity, FIGS. 5A-5F illustrate a method of creating a two ply partition 12. However, the same method may be used to create any partition used in accordance with the present invention. FIG. 5A illustrates a multilayered partition blank 66 in a planar flat orientation. FIG. 5B illustrates the multilayered partition blank 66 of FIG. 5A being folded along a fold line 74 so as to create two opposed plies 32, 34 and a rounded smooth edge 75 joining the plies as seen in FIG. 3. This smooth edge 75 becomes the upper edge of the partition 12.

Figure 5C:
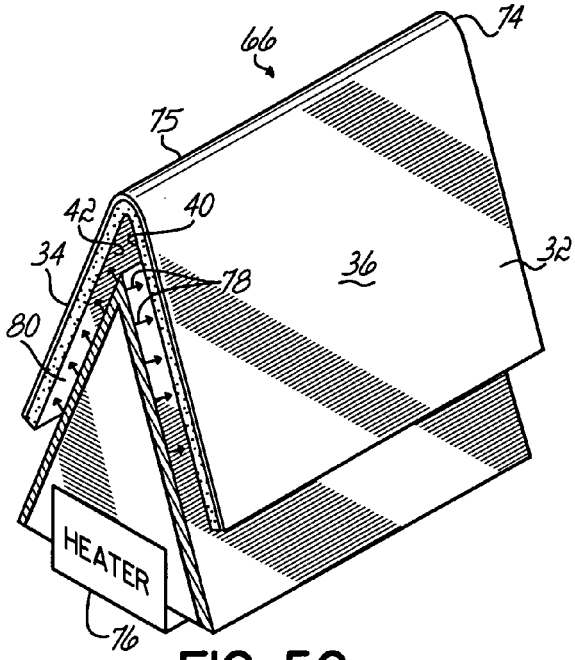
FIG. 5C is a perspective view illustrating the interior foam layers of opposed plies of the partition blank of FIG. 5A being heated.

FIG. 5C illustrates the interior foam layers 40, 42 of the opposed plies 32, 34, respectively being heated with a heat source 76. In the illustrated embodiment, the heat source 76 blows hot air in the direction of arrows 78 to heat at least one of the interior foam layers 40, 42 of the folded multilayered partition blank 66. Of course, other types of heaters may be used in accordance with the present invention to heat at least one of the interior foam layers 40, 42 of the folded multilayered partition blank 66 using any number of known methods.

Figure 5D:
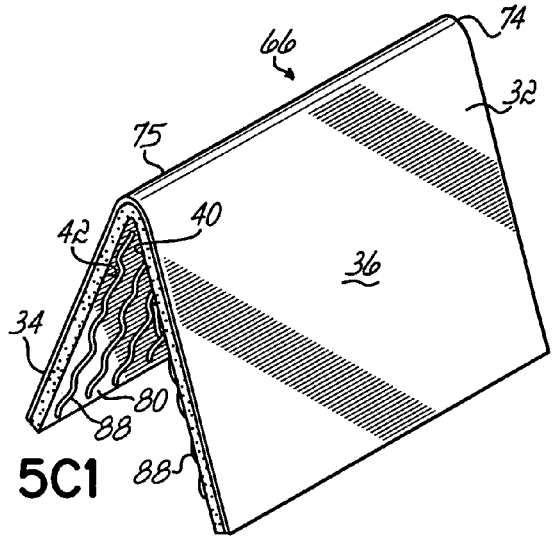
FIG. 5D is a perspective view illustrating the heated partition blank of FIG. 5C cooling under pressure according to one embodiment of the present invention.
Figure 5D:
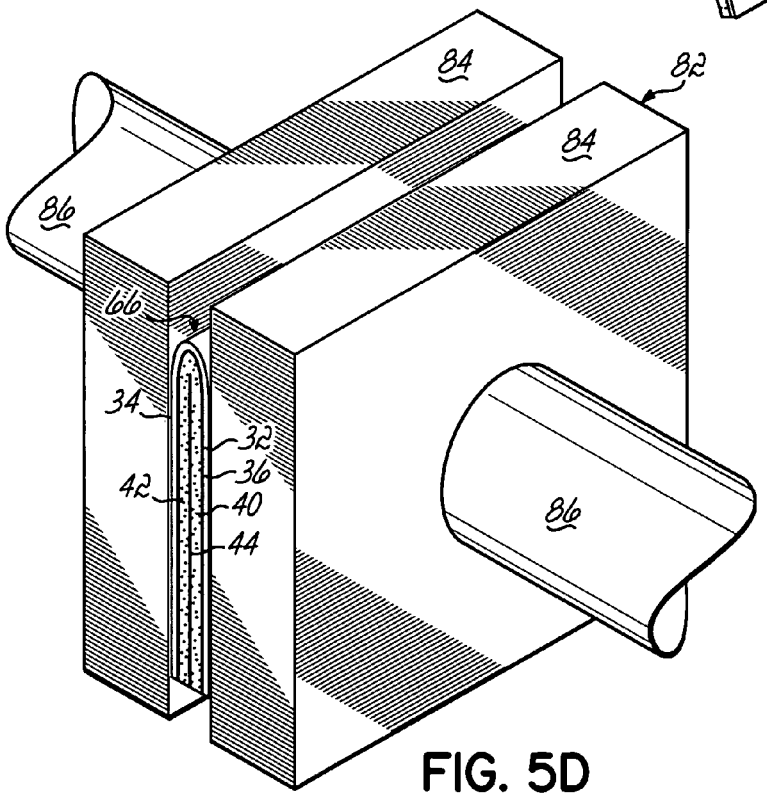

FIG. 5D illustrates the interior surfaces 80 of the foam layers 40, 42 of the opposed plies 32, 34, respectively, contacting each other and being under pressure from a pressure source 82 such as a press like the one illustrated in FIG. 5D. In the illustrated press 82 opposed plates 84 contact the outer skin 36 of the folded multilayered partition blank 66. Rods 86 extending outwardly from the plates 84 and joined thereto cause the plates to move to and away from each other in a known manner. As shown in FIG. 5D, the plates 84 push the opposed plies 32, 34 of the folded multilayered partition blank 66 together until the inner surfaces 80 thereof contact each other. Pressure is then applied by the press 82 as the opposed plies 32, 34 of the folded multilayered partition blank 66 are cooled. The result is that the foam interior layers 40, 42 of the opposed plies 32, 34 of the multilayered partition blank 66 are fused together to create partition 12. Although one type of press is illustrated any other type of device may be used to place the two opposed plies of the blank under pressure during the cooling process. Any method of cooling the opposed plies 32, 34 of the folded multilayered partition blank 66 may be used in accordance with the present invention to fuse the interior foam layers 40, 42 together including allowing the heated foam interior layer or layers to cool at room temperature.

Figure 5E:
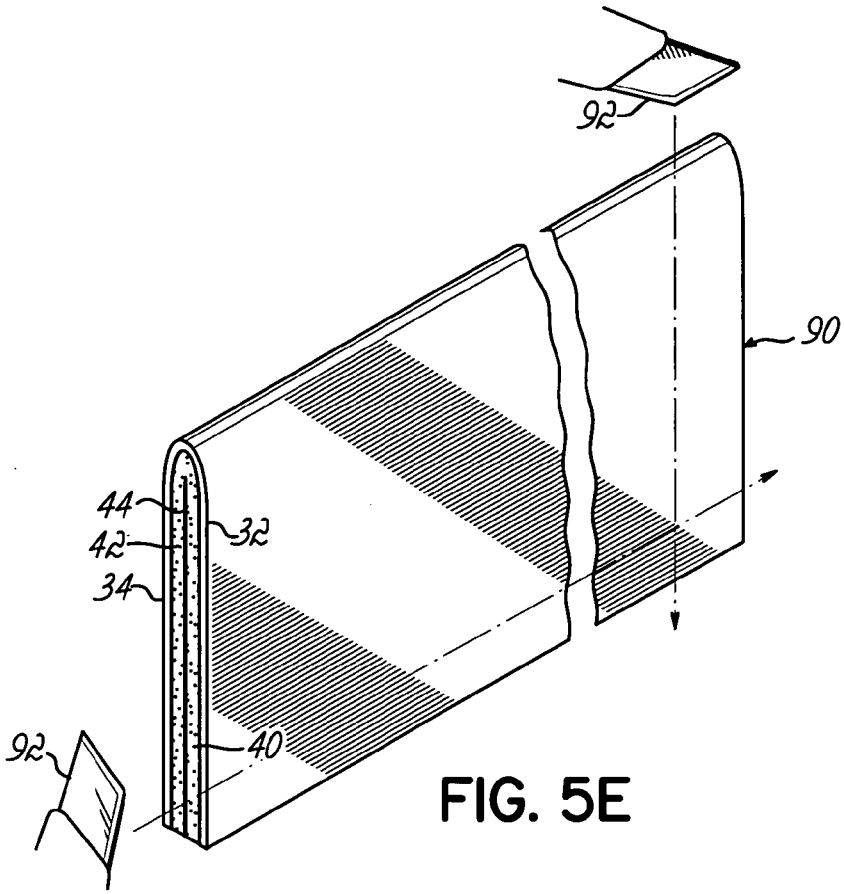
FIG. 5E is a perspective view illustrating a method of cutting a two-ply partition to size.
Figure 5F:
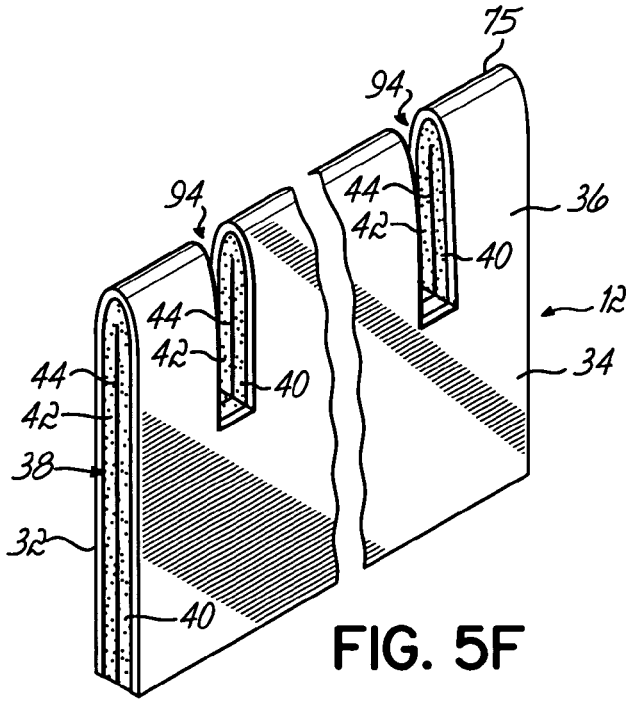
FIG. 5F is a perspective view illustrating a finished slotted partition according to one embodiment of the present invention.

As shown in FIG. 5C1, the heater may be omitted from the process of manufacturing a slotted partition 12 shown in FIG. 5F. In such a situation, adhesive 88 may be applied to the inner surfaces 80 of the opposed plies 32, 34 of the folded multilayered partition blank 66 either before or after the multilayered partition blank 66 is partially folded as shown in FIG. 5B. Other known methods of securing the opposed plies 32, 34 of the folded multilayered partition blank 66 may be used if desired.

FIG. 5E illustrates an unslotted two ply partition 90 resulting from the securing of the opposed plies 32, 34 of the folded multilayered partition blank 66 together in any manner including those described above. One or move knives 92 may be used to cut the unslotted two ply partition 90 to the desired size.

As shown in FIG. 5F, slots 94 are then cut out of the unslotted two ply partition 90 at the desired locations. The end result is a two ply slotted partition 12 for use in a partition assembly such as the one 10 shown in FIGS. 1 and 2.

While I have described only a few embodiments of my invention, I do not intend to be limited except by the scope of the following claims.

What is claimed is:

1. A partition assembly comprising:

at least one first slotted partition, each first slotted partition having at least one slot extending inwardly from an edge thereof;

at least one second slotted partition, each second slotted partition having at least one slot extending inwardly from an edge thereof;

said first and second slotted partitions being arranged in a matrix, said at least one slot of said at least one first slotted partition being engaged with said at least one slot of said at least one second slotted partition at an intersection, at least one of said partitions having a rounded upper edge, a foam interior portion and comprising opposed plies fused together wherein said opposing plies are parent welded together.

2. The partition assembly of claim 1 wherein said at least one of said partitions is made of a multi-layered material.

3. A partition assembly comprising:

at least one first slotted partition, each first slotted partition having at least one slot extending inwardly from an edge thereof;

at least one second slotted partition, each second slotted partition having at least one slot extending inwardly from an edge thereof;

said first and second slotted partitions being arranged in a matrix, said at least one slot of said at least one first slotted partition being engaged with said at least one slot of said at least one second slotted partition at an intersection, at least one of said partitions having a rounded upper edge, a foam interior portion and comprising opposed plies fused together wherein said foam interior portion is polyolefin foam.

4. A partition assembly comprising:

a plurality of first slotted partitions, each first slotted partition having a plurality of slots extending inwardly from an edge thereof;

a plurality of second slotted partitions, each second slotted partition having a plurality of slots extending inwardly from an edge thereof;

said first and second slotted partitions being arranged in a matrix, said slots of said first slotted partitions being engaged with said slots of said second slotted partitions at intersections, at least one of said partitions having a foam interior portion and an outer skin secured to said foam interior portion wherein said foam interior portion is polyolefin foam.

5. The partition assembly of claim 4 wherein said foam interior portion is two ply.

6. The partition assembly of claim 5 wherein said plies are fused together.

7. The partition assembly of claim 4 wherein said at least one of said partitions comprises opposed plies of a partition blank fused together.

8. The partition assembly of claim 4 wherein said first and second partitions are made from the same material.

9. A partition assembly comprising:

at least one first slotted partition, each first slotted partition having at least one slot extending from one edge of the first slotted partition;

at least one second slotted partition, each second slotted partition having at least one slot extending from one edge of the second slotted partition;

each of said first and second slotted partitions comprising an outer face surrounding a foam interior and a smooth upper edge, said first and second slotted partitions being arranged in a matrix, a slot of a first slotted partition being engaged with a slot of a second slotted partition at an intersection wherein said outer face of each of said partitions comprises a woven polyester.

10. A partition assembly comprising:

at least one first slotted partition, each first slotted partition having at least one slot extending from one edge of the first slotted partition;

at least one second slotted partition, each second slotted partition having at least one slot extending from one edge of the second slotted partition;

each of said first and second slotted partitions comprising an outer face surrounding a foam interior and a smooth upper edge, said first and second slotted partitions being arranged in a matrix, a slot of a first slotted partition being engaged with a slot of a second slotted partition at an intersection wherein said foam interior is polyolefin foam.

11. A partition assembly comprising:

at least one first slotted partition, each first slotted partition having at least one slot extending from one edge of the first slotted partition;

at least one second slotted partition, each second slotted partition having at least one slot extending from one edge of the second slotted partition;

each of said first and second slotted partitions comprising an outer face surrounding a foam interior and a smooth upper edge, said first and second slotted partitions being arranged in a matrix, a slot of a first slotted partition being engaged with a slot of a second slotted partition at an intersection wherein each of said partitions is formed by folding a partition blank and securing the partition blank to itself.

12. A partition assembly comprising:

at least one first slotted partition, each first slotted partition having at least one slot extending from one edge of the first slotted partition;

at least one second slotted partition, each second slotted partition having at least one slot extending from one edge of the second slotted partition;

each of said first and second slotted partitions comprising an outer face surrounding a foam interior and a smooth upper edge, said first and second slotted partitions being arranged in a matrix, a slot of a first slotted partition being engaged with a slot of a second slotted partition at an intersection wherein said outer face of each of said partitions comprises a plastic material.

13. A slotted partition for use in a partition assembly, said slotted partition comprising:

a first ply and a second ply wherein said first ply is parent welded to said second ply, wherein each of said plies comprises an interior foam portion and an exterior skin and said interior foam portion is a polyolefin foam;

a plurality of slots extending inwardly from an edge thereof.

14. A slotted partition for use in a partition assembly, said slotted partition comprising:

an interior foam portion wherein said interior foam portion of said partition is a polyolefin foam;

an exterior skin secured to the interior foam portion;

a plurality of slots extending inwardly from an edge thereof.

15. A slotted partition for use in a partition assembly, said slotted partition comprising:

a first ply and a second ply wherein said first ply is parent welded to said second ply, wherein each of said plies comprises an interior foam portion and an exterior skin;

a plurality of slots extending inwardly from an edge thereof wherein said interior foam portion of each of said plies is a polyolefin foam.

16. A partition assembly comprising:

at least one first slotted partition, each first slotted partition having at least one slot extending inwardly from an edge thereof;

at least one second slotted partition, each second slotted partition having at least one slot extending inwardly from an edge thereof;

said first and second slotted partitions being arranged in a matrix, said at least one slot of said at least one first slotted partition being engaged with said at least one slot of said at least one second slotted partition at an intersection, wherein each of said partitions has a rounded upper edge and comprises opposed plies fused together.

17. The partition assembly of claim 16 wherein each of said partitions has a foam interior portion.

18. The partition assembly of claim 17 wherein said interior foam portion is a polyolefin foam.

19. A partition assembly comprising:

at least one first slotted partition, each first slotted partition having at least one slot extending inwardly from an edge thereof;

at least one second slotted partition, each second slotted partition having at least one slot extending inwardly from an edge thereof;

said first and second slotted partitions being arranged in a matrix, said at least one slot of said at least one first slotted partition being engaged with said at least one slot of said at least one second slotted partition at an intersection, each of said partitions having a rounded upper edge and comprising opposed plies parent welded together, wherein each of said partitions has a foam interior portion and said interior foam portion is a polyolefin foam.

* * * * *

UNITED STATES PATENT AND TRADEMARK OFFICE

CERTIFICATE OF CORRECTION

PATENT NO. : 7,344,043 B2
APPLICATION NO. : 11/036809
DATED : March 18, 2008
INVENTOR(S) : Calvin D. Nyeboer It is certified that error appears in the above-identified patent and that said Letters Patent is hereby corrected as shown below:

Title Page

Under the "References Cited" section, U.S. Patent Documents, insert in the second to last line of the second column of references ---US 2001/0000568 A1 5/2001 Bambara et al---.

In the Specification

Column 2

Line 9, "may be easily separate" should be ---may easily separate---.

Column 3

Line 39, "foam, partition" should be ---foam; partition---.

Line 66, "may used" should be ---may be used---.

Column 4

The heading "BRIEF DESCRIPTION OF THE DRAWING" should be ---BRIEF DESCRIPTION OF THE DRAWINGS---.

Column 5

Line 45, delete the "," after the word "case".

Signed and Sealed this
Fourteenth Day of October, 2014

Michelle K. Lee

Michelle K. Lee
*Deputy Director of the United States Patent and Trademark Office*

Column 6

Line 8, “may used” should be ---may be used---.

Line 24, “may used” should be ---may be used---.

Line 36, “method of” should be ---methods of---.